United States Patent [19]

Khokhulin et al.

[11] 4,150,511

[45] Apr. 24, 1979

[54] DEVICE FOR FINISHING SHAPED SURFACES WITH AN ABRASIVE TOOL

[75] Inventors: Vladimir N. Khokhulin, Okhtensky prospekt, 2v/17, kv. 75; Jury V. Ladygin, prospekt Narodnogo opolchenia, 121, kv. 65; Valery G. Shver, Bolshoi prospekt, 104, kv. 24, all of Leningrad, Sr. U.S.S.R.

[73] Assignee: Proizvodstvennoe Obiedinenie Turbostroenia Leningradsky Metallichesky Zavod, U.S.S.R.

[21] Appl. No.: 796,441

[22] Filed: May 12, 1977

[51] Int. Cl.[2] ..... B24B 19/14

[52] U.S. Cl. ..... 51/67; 51/59 R

[58] Field of Search ..... 51/34 A, 34 C, 50 R, 51/43, 59 R, 67, 68

[56] References Cited

U.S. PATENT DOCUMENTS

| | | | |
|---|---|---|---|
| 1,172,274 | 2/1916 | Gargan | 51/43 |
| 1,990,074 | 2/1935 | Helmstadter | 51/59 R |
| 2,278,657 | 4/1942 | Kline | 51/59 R X |
| 2,356,272 | 8/1944 | Reynolds | 51/67 X |
| 2,626,486 | 1/1953 | Olson | 51/59 R |
| 2,834,160 | 5/1958 | Lillie | 51/50 R X |

*Primary Examiner*—Gary L. Smith

*Attorney, Agent, or Firm*—Robert E. Burns; Emmanuel J. Lobato; Bruce L. Adams

[57] ABSTRACT

A device for finishing shaped surfaces with an abrasive tool comprises a fixed base connected to a copying mechanism having a reciprocating carriage moving on the fixed base and carrying a double-arm lever pivotally mounted on a spherical bearing. Secured on one arm of the lever is an abrasive tool performing periodic swivelling motion about its own axis from a turning mechanism. The abrasive tool is urged to the surface being mechined by means of a hold-down member operatively connected with the second arm of the lever, the axis of the hold-down member passes through the center of the spherical bearing of the lever. The device of the present invention ensures an effect of urging of the tool in any point of the surface of intricate shape being machined.

2 Claims, 2 Drawing Figures

DEVICE FOR FINISHING SHAPED SURFACES WITH AN ABRASIVE TOOL

BACKGROUND OF THE INVENTION

The present invention relates to machine tools, and more particularly to devices for finishing shaped surfaces with an abrasive tool. The invention may be used most successfully for finishing shaped surfaces of gas and steam turbine blades. The device of the present invention may be used, particularly, on transverse circular milling machines for finishing (dimensionless) of turbine blades preliminarily machined on the same machine tools.

One of the main unsolved problems in manufacturing powerful steam and gas turbines is the problem concerning mechanised finishing of shaped surfaces of blades having a variable profile. In the world practice most of the large blades are ground with manual grinding devices. The process is unproductive, harmful to health, and it fails to ensure the stability of dimensions and of the quality of the machined surfaces. High contact temperature in the process of grinding gives rise to stresses in the surface layer reaching 40 kg/mm$^2$, to burned local surface areas and to microcracks.

Known in the art is a device for finishing blade surfaces comprising an abrasive tool secured on a lever and spring-urged to the surface being machined. The tool reciprocates relative to the blade surface being machined and the blade rotates about its axis. Besides, the blade may be moved in two mutually perpendicular directions, the movement being effected from a copying mechanism.

A disadvantage of this device consists in the fact that it machines only the outer shaped surface of the blade and fails to machine the inner shaped surface of the blade because the tool cannot be accommodated at the inner surface.

Another known device for machining spherical surfaces comprises a fixed base with a carriage mounted on it. The carriage performing a reciprocating motion along the generatrix of the work-piece being machined, while the latter rotates about its axis. The carriage is provided with a hinged support for a pivoting double-arm lever. The pivoting axis of the lever is parallel to the direction in which the carriage moves. One arm of the lever carries an abrasive tool.

The reciprocating motion of the carriage is brought about by a drive mechanism consisting of a rotating drive shaft and of an eccentric mechanism coupled to the carriage. The carriage is spring-urged thereby providing for the abrasive tool to be urged to the surface being machined.

A disadvantage of the above-mentioned device consists in the fact that it machines only surfaces of workpieces having the shape of bodies of rotation. When such devices are used for finishing workpieces which do not have the shape of bodies of rotation, such a device wouldn't ensure a permanent effect of urging of the tool to the surface being machined, because the effect of urging in this case would not be normal to the surface being machined at any point of contact with the tool.

SUMMARY OF THE INVENTION

It is an object of the present invention to provide a device for finishing shaped surfaces with an abrasive tool ensuring a permanent effect of urging of the tool to the surface being machined in any point thereof.

It is another object of the present invention to provide a device for finishing shaped surfaces, ensuring circular machining of workpieces such as work blades of steam and gas turbines, in particular, the circular machining of outer and inner shaped surfaces of blades and of their work edges.

It is still another object of the present invention to provide a device for finishing surfaces of intricate shape with an abrasive tool which would ensure high accuracy of surface finishing.

These and other objects are achieved by a device for finishing shaped surfaces with an abrasive tool comprising a fixed base connected to a copying mechanism, a carriage reciprocating along said fixed base, a drive mechanism for the reciprocating motion of the carriage, a pivoting double-arm lever mounted on the carriage and one arm of which lever supports an abrasive tool urged to the surface being machined by a hold-down member, according to the invention, the double-arm lever is mounted on a spherical bearing, and the hold-down member interacts with the end surface of the second arm of the lever, and the axis of the hold-down member passing through the center of the spherical bearing of the lever.

The advantages of the present invention consist in the fact that by mounting the lever with the tool on the spherical bearing and by disposing the center of the spherical bearing on the same line with the axis of the hold-down member the double-arm lever will work as a self-adjusting one, i.e. if displaced from the equilibrium position, it will tend, by virtue of the action of the hold-down member, to return to the original position, producing en effect of urging of the tool to the surface being machined. The effect is normal to the surface at the contact point. In this case the effect of urging will be permanent at any point of the shaped surface of the workpiece, i.e. in the convex and concave portions of the surface, and in the transfer areas, such as the outer and inner shaped surfaces of turbine blade and its edges.

According to one embodiment of the invention, the end surfaces of the hold-down member and of the second arm of the lever, facing each other, have conic recesses with a ball disposed between them.

BRIEF DESCRIPTION OF THE DRAWINGS

These and other objects as well as the advantages of the invention will become clear hereinafter from the following detailed description of an example of the embodiment of the invention accompanied by drawings in which.

DESCRIPTION OF THE PREFERRED EMBODIMENT

Figure 1:
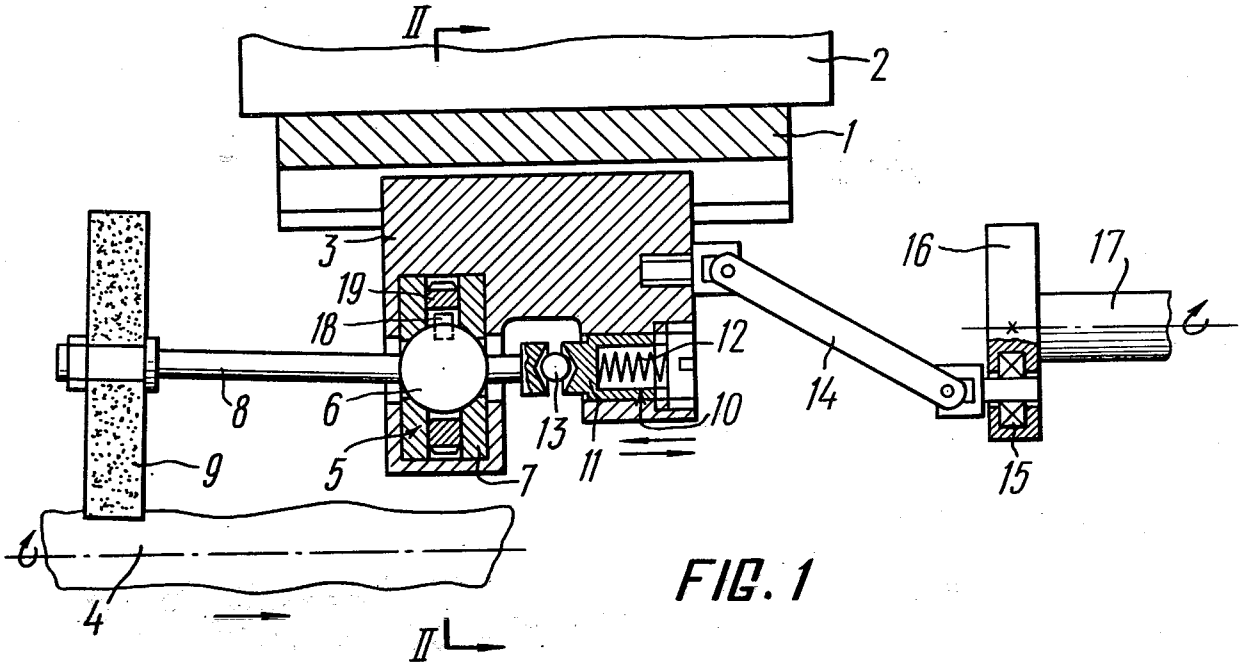
FIG. 1 is a longitudinal section of a device for finishing shaped surfaces with an abrasive tool, according to the invention.

Referring to FIG. 1, the device for finishing shaped surfaces with an abrasive tool comprises a fixed base 1 rigidly connected to a copying mechnism 2 of e.g., a transverse circular milling machine, and a carriage 3 mounted on the fixed base 1 and movable to perform a reciprocating motion with respect to the fixed base 1 and along the axis of a workpiece 4 such as a steam or gas turbine blade being machined. In the carriage 3, on a spherical bearing 5 comprising a male part 6 and a female part 7, a double-arm lever 8 is installed and an abrasive tool 9 is fixedly secured on one arm of the double-arm lever 8. The second arm of the double-arm lever 8 has a conic recess on its end surface and is operatively connected with a hold-down member 10 mounted in the carriage 3 so that its axis passes through the center of the spherical bearing of the lever 8. The hold-down member 10 is made in the form of a sleeve 11 with a spring 12 secured in it, a conic recess is also formed in the end surface of the sleeve 11 facing the lever 8. Between the conic recesses in the end surfaces of the second arm of lever 8 and of the hold-down member 10 there is mounted a ball 13.

The reciprocating motion of the carriage 3 along the axis of the workpiece 4 is provided by the drive of the carriage. The drive comprises a coupling link 14 one end of which is hingedly connected to the carriage 3, and the other end, through bearing 15, is hingedly connected to a disk 16 secured on a rotatable drive shaft 17. The drive shaft 17 is rotated, e.g., from the spindle of the said machine tool (not shown). The ends of the coupling link 14 are disposed beyond the axis of the shaft 17 to provide for the reciprocating motion of the carriage 3 when the shaft 17 rotates. With increased passes of the carriage 3, the bearing 15 facilitates the swivelling of the joint of coupling link 14 connected to the disk 16.

Figure 2:
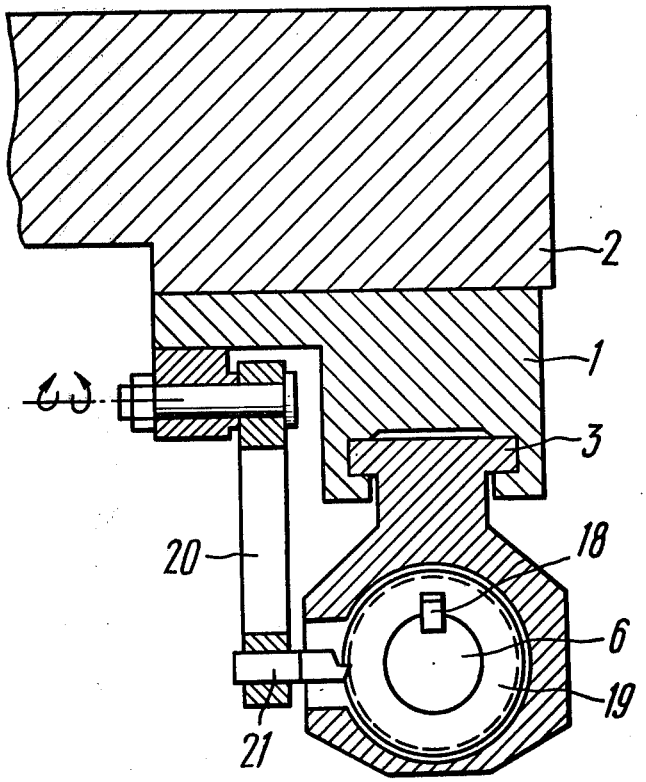
FIG. 2 is a section along the section line in FIG. 1.

Mounted on the male part 6 of the spherical bearing 5 of the lever 8, and radially to the support and perpendicular to the axis of the lever 8 is disposed a cylindrical pin 18 as well as a ratchet wheel 19 having a keyslot. The free end of the pin 18 enters the keyslot on the ratchet wheel 19 so that the pin 18 may turn relative the female part 7 of the bearing 5 within the swivelling range of the lever 8. Attached to the fixed base 1 is a rod 20 (FIG. 2) adapted to oscillate in the direction of the reciprocating motion of the said carriage 3. On the free end of the rod 20 a ratchet 21 is fixedly secured, engaging the ratchet wheel 19. The ratchet wheel 19, the rod 20 and the ratchet 21 form means for swivelling the tool 9 about its axis allowing for a uniform wear of the working surface of the tool 9.

The device of the invention operates as follows.

Before operation the abrasive tool 9 is advanced and resiliently urged to the surface of the workpiece 4 by the hold-down member 10. The rotation of the drive shaft 17 together with the disk 16 is transformed by the coupling link 14 into reciprocating motion of the carriage 3 with the lever 8 and the abrasive tool 9 relative to the surface 4 being machined. In addition, the lever 8 with tool 9 turns with respect to the spherical bearing 5 in any direction in accordance with the shape of the surface being machined, while the hold-down member 10 operating through the ball 13 on the second arm of the said lever 8, tends to return the lever 8 to the position where its axis coincides with the axis of the hold-down member 10, producing an effect of urging of the tool 9 to the surface 4 being machined. The effect of urging is permanent in any point of the surface 4 being machined and is normal to the surface 4 in the point of its contact with the tool 9, in spite of the fact that the contact point on the tool 9 changes. The constancy of the effect of urging is achieved by disposing the center of the spherical bearing 5 of the lever 8 on the same line with the axis of the hold-down member 10.

In operation, the workpiece 4, such as a steam or gas turbine blade, is displaced with respect to the tool 9 in the direction of its reciprocating motion as well as rotated about its own axis.

The rod 20, for every double pass of the carriage 3, performs one swinging motion about its axis, displacing the ratchet 21 in the direction normal to the axis of the ratchet wheel 19. The ratchet wheel 19, through the pin 18 and lever 8, transmits the rotation to the abrasive tool 9.

The permanent effect of urging the tool 9 to the surface 4 being machined allows for high accuracy of surface finishing.

The device of the present invention ensures machining at lower speeds than grinding, which in fact enables to eliminate burned surface areas during the machining operation and minimize the residual stresses in the surface layer.

The device of the present invention enables to machine, e.g., the shaped parts of steam and gas turbine blades made not only of stainless steels and heat resistant alloys, but also of titanium alloys.

While above we have described the concrete embodiment of the present invention, it should be understood that this is only by way of example and that various modifications and changes may be made to the device described without departing from the spirit and scope of our invention as claimed below.

What is claimed is:

1. A device for finishing shaped surfaces with an abrasive tool, comprising:

a fixed base;

a carriage movably mounted on said fixed base and reciprocably driven to perform a reciprocating motion relative to said base;

a drive for reciprocatingly driving said carriage;

a pivoting double-arm lever pivotally mounted in said carriage and having a first and a second arm;

a spherical bearing for said lever disposed in said carriage mounting said lever pivotally in said carriage;

an abrasive tool secured on a first arm of the said lever;

turning means for rotational turning of said first arm and abrasive tool about an axis thereof, and a hold-down member mounted in said carriage operatively connected with an end surface of said second arm of said lever effective to urge said abrasive tool to continuously engage the surface being machined and maintaining the axis of said hold-down member passing through the center of said spherical bearing of said lever;

thereby ensuring the a continous urging of said abrasive tool on to every point of contact with the surface being machined.

2. A device for finishing shaped surfaces with an abrasive tool according to claim 1, wherein a second arm of said lever and said hold-down member each have, on their end surfaces opposed to each other, conic recesses, and a ball disposed between and held in said conic recesses.

* * * * *